US005079823A

United States Patent [19]

Walter et al.

[11] Patent Number: 5,079,823

[45] Date of Patent: Jan. 14, 1992

[54] PROCESS FOR CLOSING THE EVAPORATION CHAMBER OF AN ELECTRICALLY HEATED STEAM IRON

[75] Inventors: Robert Walter, Eppertshausen; Emil Steinebrunner, Dietzenbach, both of Fed. Rep. of Germany

[73] Assignee: Rowenta-Werke GmbH

[21] Appl. No.: 654,345

[22] Filed: Feb. 12, 1991

[30] Foreign Application Priority Data

Feb. 26, 1990 [DE] Fed. Rep. of Germany ..... 4005941

[51] Int. Cl.[5] ..... B23P 11/00

[52] U.S. Cl. ..... 29/509; 29/243.517; 29/525; 38/88; 38/93

[58] Field of Search ..... 29/509, 510, 511, 512, 29/513, 243.517, 243.518, 243.519, 243.520, 243.521, DIG. 37, 432.2, 521, 525; 38/88, 77.8, 77.83, 77.9, 93; 72/363, 379

[56] References Cited

U.S. PATENT DOCUMENTS

| | | | |
|---|---|---|---|
| 1,776,947 | 9/1930 | Kocourek | 38/88 X |
| 2,500,091 | 3/1950 | Parr | 38/88 |
| 3,055,528 | 9/1962 | Seifert | 29/243.521 |
| 4,658,520 | 4/1987 | Henneberger et al. | 38/93 |
| 4,995,177 | 2/1991 | Louison et al. | 38/93 X |

FOREIGN PATENT DOCUMENTS

| | | | |
|---|---|---|---|
| 1048094 | 12/1958 | Fed. Rep. of Germany . | |
| 219831 | 3/1985 | Fed. Rep. of Germany . | |
| 3517018 | 11/1986 | Fed. Rep. of Germany . | |
| 990294 | 9/1951 | France | 38/88 |
| 1244397 | 10/1986 | Japan | 38/88 |

*Primary Examiner*—Joseph M. Gorski
*Assistant Examiner*—Peter Dungba Vo
*Attorney, Agent, or Firm*—Toren, McGeady & Associates

[57] ABSTRACT

A process for closing an evaporation chamber of an electrically heated steam iron having a sole member, an evaporation chamber fixedly connected to the sole member and closable by a lid, said evaporation chamber having a vertical steam chamber wall with a top surface on which rivets with a substantially frustoconical rivet base are cast, and the lid having rivet holes associated with each rivet, the cross-section of each rivet hole being equal to or greater than the cross-section of the base of the rivet associated with the rivet hole, the process including the steps of: placing the lid on the top surface of the steam chamber wall, subjecting a rivet-hole edge portion of each rivet hole to pressure of a ring stamp, increasing the pressure of the ring stamp until the flow limit of the lid material is exceeded, this flow limit being lower than that of the material of the sole member, releasing the ring stamp after permanent deformation of the rivet-hole edge portion, clinching the rivet, and deforming the free end of each rivet to join the lid to the sole member.

1 Claim, 1 Drawing Sheet

PROCESS FOR CLOSING THE EVAPORATION CHAMBER OF AN ELECTRICALLY HEATED STEAM IRON

BACKGROUND OF THE INVENTION

The invention relates to a process for closing the evaporation chamber of an electrically heated steam iron having a sole member generally made of die-cast aluminium, an evaporation chamber fixedly connected to the sole member and closable by means of a lid, having a vertical steam chamber wall. The top surface of said evaporation chamber has rivets cast thereon with a substantially frustoconical base, and the lid has rivet holes associated with each rivet. The diameter of each rivet hole is equal to or larger than the diameter of the base of the rivet associated with the rivet hole and, after being placed on the top surface of the wall of the evaporation chamber the lid is attached to the sole member by deformation of the rivets.

In electric steam irons operating by the drip principle, the evaporation chamber in which water is converted from liquid form into vapor, and the associated steam channels, are provided in the electrically heated sole member. The water drips out of the water tank into the evaporation chamber. The wet steam thus produced is superheated in the steam channels and emerges on the ironing surface of the sole member. The sole member generally consists of die-cast aluminium. The evaporation chamber provided in the sole member, and the steam channels, are sealed off by means of a lid. As a result of the evaporation of the water and the physical processes which accompany this, pressure is generated in the evaporation chamber, acting all over the chamber walls.

The weakest point of the evaporation chamber is the point where the lid of the evaporation chamber joins the sole member which, is known steam irons, is produced by riveting. For this purpose, rivets having a substantially frustoconical base are cast on the top surface of the vertical steam chamber wall. The lid has rivet holes associated with each rivet. After the lid has been placed on the top surface of the steam chamber wall, the lid is fixedly connected to the sole member by deformation of the rivets. This known process has the disadvantage that the lid is connected to the sole member only by means of the deformed rivet heads. Since the rivets are cast on the steam chamber wall, it is absolutely necessary, for reasons of casting technology, for the base of each rivet to be frustoconical in shape. Moreover, owing to the tight joint between the lid and the evaporation chamber, before the riveting operation the lid must sit flush on the top surface of the steam chamber wall. This means that the cross-section of the rivet hole associated with each rivet in the cover must be equal to or larger than the maximum cross-section of the rivet base. As a result of the frustoconical rivet base, the volume of the rivet hole is not completely filled by the compressed rivet shank at the end of the riveting operation and the cross-section of the rivet head is only slightly bigger than the cross-section of the rivet hole. The rivet exerts no bearing pressure on the lid. As a result of the pressure acting on the lid from the evaporation chamber, the individual rivets are not subjected to tension, owing to the lack of bearing pressure. The pressure of the evaporation chamber acts solely as a shearing force on the rivet head. The lid is raised by the pressure of the evaporation chamber and the rivet heads are burst off by the shearing forces. As a result of the resulting leakage between the lid and the wall of the evaporation chamber, vapour and hence moisture penetrate into the interior of the iron. In the known steam irons, there is an exceptionally great danger that leakage currents will cause a short circuit or that a user will come into contact with the voltage of the appliance and suffer damage to his or her health.

SUMMARY OF THE INVENTION

The object of the present invention is to provide a particular process by means of which the lid of the evaporation chamber of a steam iron of the type in question can be permanently connected to the sole member in leaktight manner without giving rise to the disadvantages described above.

Pursuant to this object, and others which will become apparent hereafter, one aspect of the present invention resides in subjecting a rivet-hole edgee portion of each rivet hole to the pressure of a ring stamp. The pressure of the ring stamp is increased until the flow limit of the lid material is exceeded. After permanent deformation of the rivet-hole edge portion, the ring stamp is released, the rivet is clinched and the free end of each rivet is deformed.

The process according to the invention ensures that, as a result of the considerable ring stamping pressure, the flow limit of the lid material is exceeded and the lid material flows up to each rivet in the edge region of the rivet holes. Each rivet is firmly surrounded by the lid material in the region of the walls of the rivet holes. Any gaps between the rivet and lid are completely filled by the displaced lid material. After the rivet shank has been clinched and the rivet head deformed, the edge portion of each rivet hole in the lid is extensively covered. After the riveting operation has ended, a high bearing pressure is exerted on the lid by each rivet shank. A form-locking and tensional connection is produced between the individual rivets and the lid, so that the rivett heads are not subjected solely to shear forces. The pressure exerted on the chamber wall and lid from the evaporation chamber cannot undo the riveted connection between the lid and the wall of the evaporation chamber, since the rivets are subjected predominantly to tensile stress by the pressure. As the diameter of the rivet head is substantially greater than the diameter of the rivet hole, the rivet heads cannot be burst off by the predominantly tensile forces occurring, and consequently an absolutely leaktight and unbreakable joint is produced between the lid and the wall of the evaporation chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
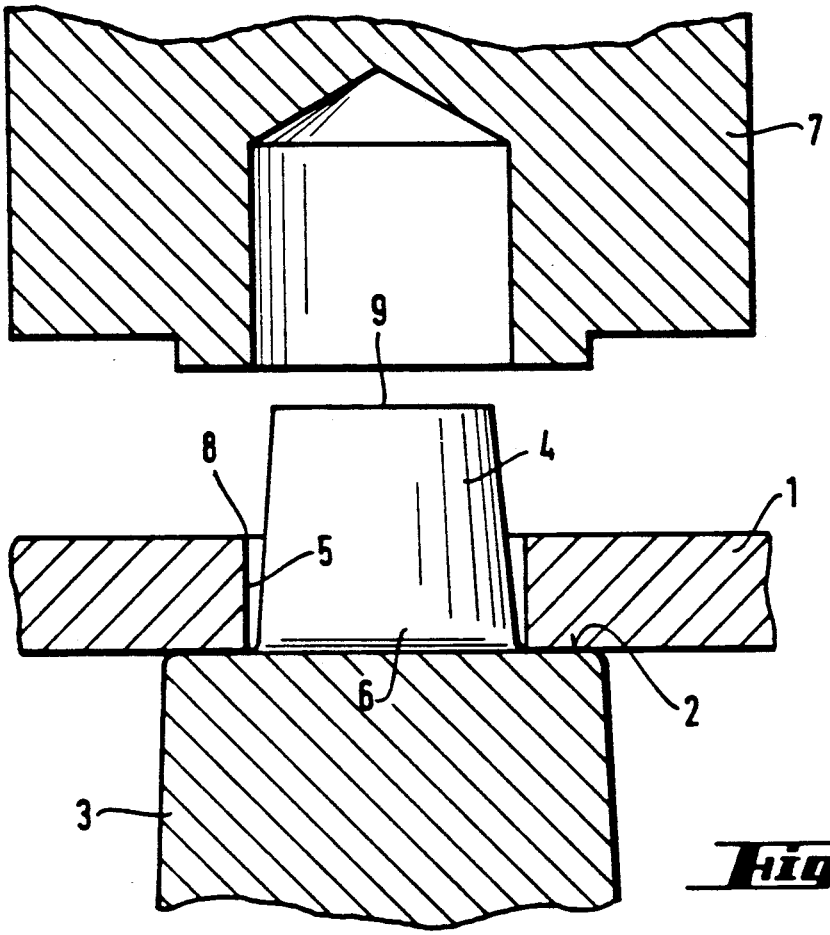
FIG. 1 shows part of an evaporation chamber of a steam iron and a ring stamp, in section.
Figure 2:
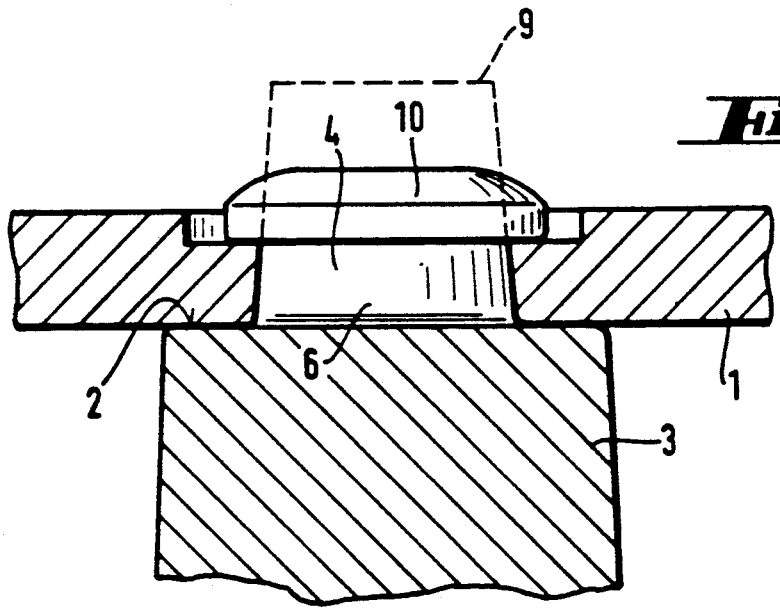
FIG. 2 shows part of the evaporation chamber according to FIG. 1 after the process according to the invention has been carried out.

FIG. 1 shows part part of the evaporation chamber of a steam iron before the evaporation chamber has been joint to the lid 1. On the top surface 2 of the wall 3 of the evaporation chamber, rivets 4 are cast, their base 6 being frustoconical, owing to the practicalities of the casting operation. The lid 1 rests on the top surface 2 of the vertical wall 3 of the evaporation chamber. The rivet hole 5 associated with each rivet 4 has a cross-section which is equal to or larger than the maximum cross-section of the associated rivet base 6. When the process according to the invention is carried out, the lid 1 is placed on the top surface 2 of the evaporation chamber wall 3 and a ring stamp 7 is lowered onto the lid 1 bypassing the rivet 4. The respective rivet-hole edge portion 8 of the lid 1 is subjected to the pressure of the ring stamp 7 until the flow limit of the lid material is exceeded. The lid material flows towards the rivet 4, so that the rivet shank is surrounded on all sides by the displaced lid material. After permanent deformation of the rivet-hole edge portion 8, the rivet 4 is clinched and the free end 9 of the rivet 4 is deformed to make a rivet head 10. It is conceivable for a plurality of ring stamps 7 to act on the rivet-hole edge portions 8 of the lid 1 in order to close off the evaporation chamber of the sole of an iron by means of the lid 1 and for the evaporation chamber to be sealed by the process according to the invention in a single operation. FIG. 2 shows a partial view of the evaporation chamber with the lid 1 secured thereon after the process according to the invention has been carried out. It can be seen from this illustration that the rivet 4 is firmly and tightly surrounded by the lid material and the rivet head 10 projects over a large area of the rivet hole edge portion 8 of the lid 1.

While the invention has been illustrated and described as embodiment in a process for closing the evaporation chamber of an electrically heated seam iron, it is not intended to be limited to the details shown, since various modifications and changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claim:

1. A process for closing an evaporation chamber of an electrically heated steam iron having a sole member, an evaporation chamber fixedly connected to the sole member and closable by means of a lid, said evaporation chamber having a vertical steam chamber wall with a top surface on which rivets with a substantially frustoconical rivet base are cast, each of said rivets having a free end and the lid having rivet holes associated with said rivets, each of said rivet holes having a cross-section which being equal to or greater than the cross-section of the base of the associated rivet, the process comprising the steps of:

placing the lid on the top surface of the steam chamber wall;

subjecting a rivet-hole edge portion (8) of each rivet hole (5) to pressure of a ring stamp (7);

increasing the pressure of the ring stamp (7) until a flow limit of the lid material is exceeded, said flow limit of the lid material being lower than that of the material of the sole member;

releasing the ring stamp (7) after permanently deforming the rivet-hole edge portion (8);

clinching the rivet (4); and deforming the free end (9) of each of said rivets (4) thereby joining the lid to the sole member.

* * * * *

UNITED STATES PATENT AND TRADEMARK OFFICE

CERTIFICATE OF CORRECTION

PATENT NO. : 5,079,823

DATED : 14 January 1992

INVENTOR(S) : Robert Walter et al.

It is certified that error appears in the above-identified patent and that said Letters Patent is hereby corrected as shown below:

On title page, Item(73) Assignee: Rowenta-Werke GmbH,
Offenbach am Main,
Federal Republic of Germany Signed and Sealed this Fourteenth Day of June, 1994

Bruce Lehman

BRUCE LEHMAN

*Commissioner of Patents and Trademarks*

*Attest:*

*Attesting Officer*